US006866813B1

(12) United States Patent
Trubitt

(10) Patent No.: US 6,866,813 B1
(45) Date of Patent: Mar. 15, 2005

(54) INFLATABLE TOY WITH EXPANDABLE FIGURINE

(76) Inventor: Adam G. Trubitt, 12065 Rue Montereau, San Diego, CA (US) 92131

( * ) Notice: Subject to any disclaimer, the term of this patent is extended or adjusted under 35 U.S.C. 154(b) by 0 days.

(21) Appl. No.: 10/646,255

(22) Filed: Aug. 22, 2003

(51) Int. Cl.[7] ..... B29C 39/02; A63H 3/06

(52) U.S. Cl. ..... 264/523; 264/572; 264/291; 264/349; 446/220; 446/226; 156/229

(58) Field of Search ..... 446/220, 221, 446/223, 226, 185, 183, 180, 199, 198; 40/412, 421, 439, 538; 264/523, 572, 291, 349; 156/344, 347, 229

(56) References Cited

U.S. PATENT DOCUMENTS 2,487,546 A * 11/1949 Harrowe ..... 446/189
3,026,648 A * 3/1962 Lemelson ..... 446/226
3,098,317 A * 7/1963 Guzman ..... 446/226
3,988,792 A * 11/1976 Klein ..... 40/736
4,268,030 A 5/1981 Richards ..... 272/77
4,372,071 A * 2/1983 Vicino ..... 40/624
4,895,546 A 1/1990 Rakonjac ..... 446/221
5,125,177 A * 6/1992 Colting ..... 40/610
5,162,013 A 11/1992 von Mohr ..... 446/320
5,338,243 A 8/1994 Kieves ..... 446/220
6,439,950 B1 8/2002 Goldman et al. ..... 446/220

* cited by examiner

*Primary Examiner*—Bena B. Miller

(57) ABSTRACT

An inflatable toy comprises an inflatable volume and an expandable figurine that is attached to the inflatable volume such that the figurine is stretched as the volume is inflated. The expandable figurine assumes a first predetermined shape when the inflatable volume is in a deflated state, and assumes a second predetermined shape representing a distortion of the first predetermined shape when the inflatable volume is substantially inflated. The figurine can be removably attached to an outer surface of the inflatable volume. The figurine can comprise a body portion having multiple limbs, such that the limbs are attached to the inflatable volume outer surface and are pulled away from the figurine body portion as the volume is inflated.

2 Claims, 9 Drawing Sheets

INFLATABLE TOY WITH EXPANDABLE FIGURINE

BACKGROUND

1. Field

The present invention relates generally to toys for amusement and, more specifically, to inflatable toys.

2. Background

Inflatable toys are generally constructed to assume a desired shape after inflation. Balloons, for example, typically adopt a spherical shape upon inflation, or can be constructed to assume the shape of a desired character or object. Other inflatable toys are constructed to transform in shape or appearance as they expand in volume during inflation. The transformation can provide additional amusement. Some inflatable toys, for example, comprise a balloon that encloses a picture or scene. The picture is apparent only after the balloon has been inflated. Other inflatable toys provide one shape at a particular volume of balloon inflation, but might assume a second shape at a different volume of inflation.

Many of these transforming inflatable toys are of relatively complex construction that can require relatively sophisticated manufacturing techniques or assembly. The complex construction can increase costs. The market for most inflatable toys, generally being novelty items purchased for purposes of amusement, can be rather price sensitive. The construction cost of such toys can result in greater retail prices, which can be a hindrance to greater popularity and sales of such toys.

From the discussion above, it should be apparent that there is a need for an inflatable toy that is of reduced complexity and that is easier to manufacture at modest cost, while providing entertainment and amusement. The present invention fulfills this need.

SUMMARY

An inflatable toy comprises an inflatable volume and an expandable figurine that is attached to the inflatable volume such that the figurine is stretched as the volume is inflated. The expandable figurine assumes a first predetermined shape when the inflatable volume is in a deflated state, and assumes a second predetermined shape comprising a distortion of the first shape when the inflatable volume is substantially inflated.

In one aspect of the invention, the figurine can be removably attached to the inflatable volume. The figurine can comprise a body portion having multiple limbs, and the limbs can be attached to the inflatable volume such that the limbs are pulled away from the body portion as the volume is inflated.

Other features and advantages of the present invention should be apparent from the following description of the preferred embodiments, which illustrate, by way of example, the principles of the invention.

DETAILED DESCRIPTION

Figure 1:
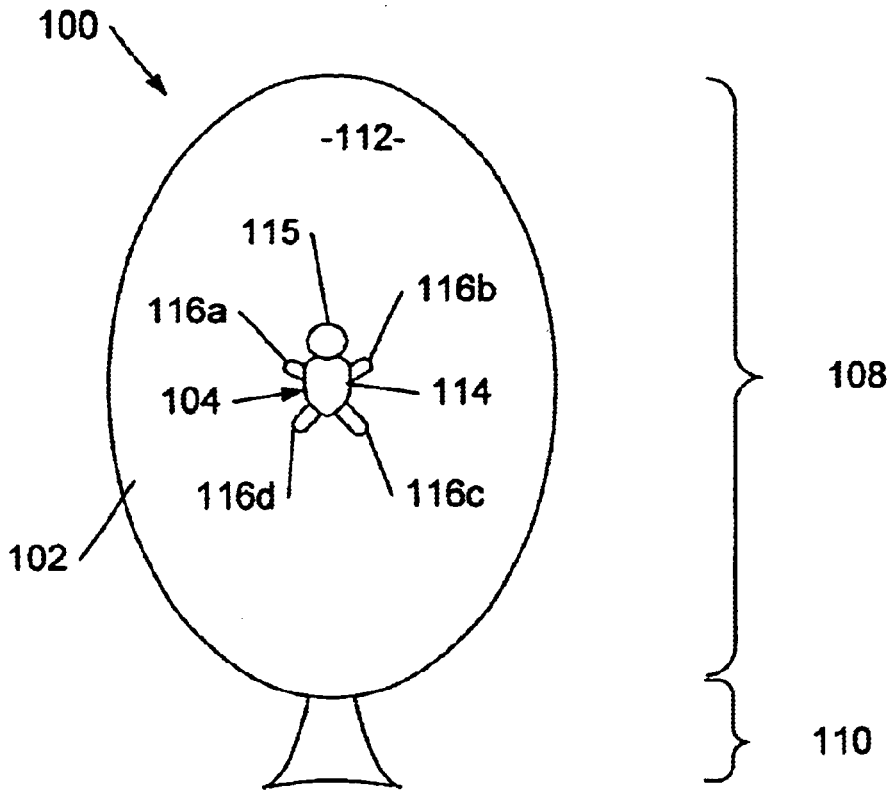
FIG. 1 is a perspective view of an inflatable toy constructed in accordance with the invention.
Figure 2:
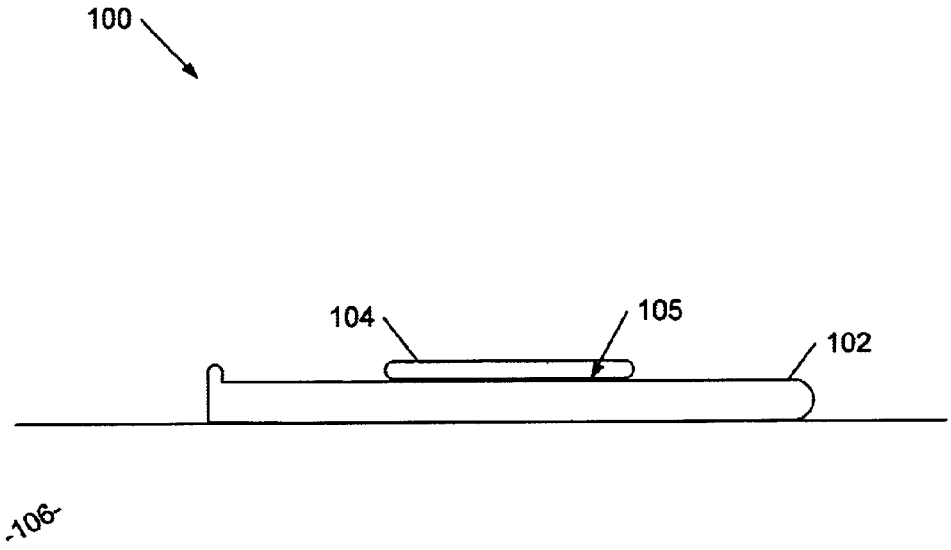
FIG. 2 is a side view of the FIG. 1 inflatable toy lying on a flat surface.

The inflatable toy 100 shown in FIG. 1 includes an inflatable volume 102, such as a balloon, to which is attached an expandable figurine 104. The expandable figurine can comprise, for example, a molded rubber bodily shape or form. Typically, the figurine is selected to comprise a shape of interest to a target market segment, such as young children, and will therefore depict a frog, an animal, or other living creature. FIG. 1 shows the inflatable toy 100 in a non-inflated condition laid down on a surface. FIG. 2 is a side view of the FIG. 1 toy 100 in the non-inflated condition, showing the toy 100 laid on a flat surface 106. FIG. 2 shows that the figurine 104 lies on top of the inflatable volume 102 and is attached along a figurine bottom surface 105.

Figure 3:
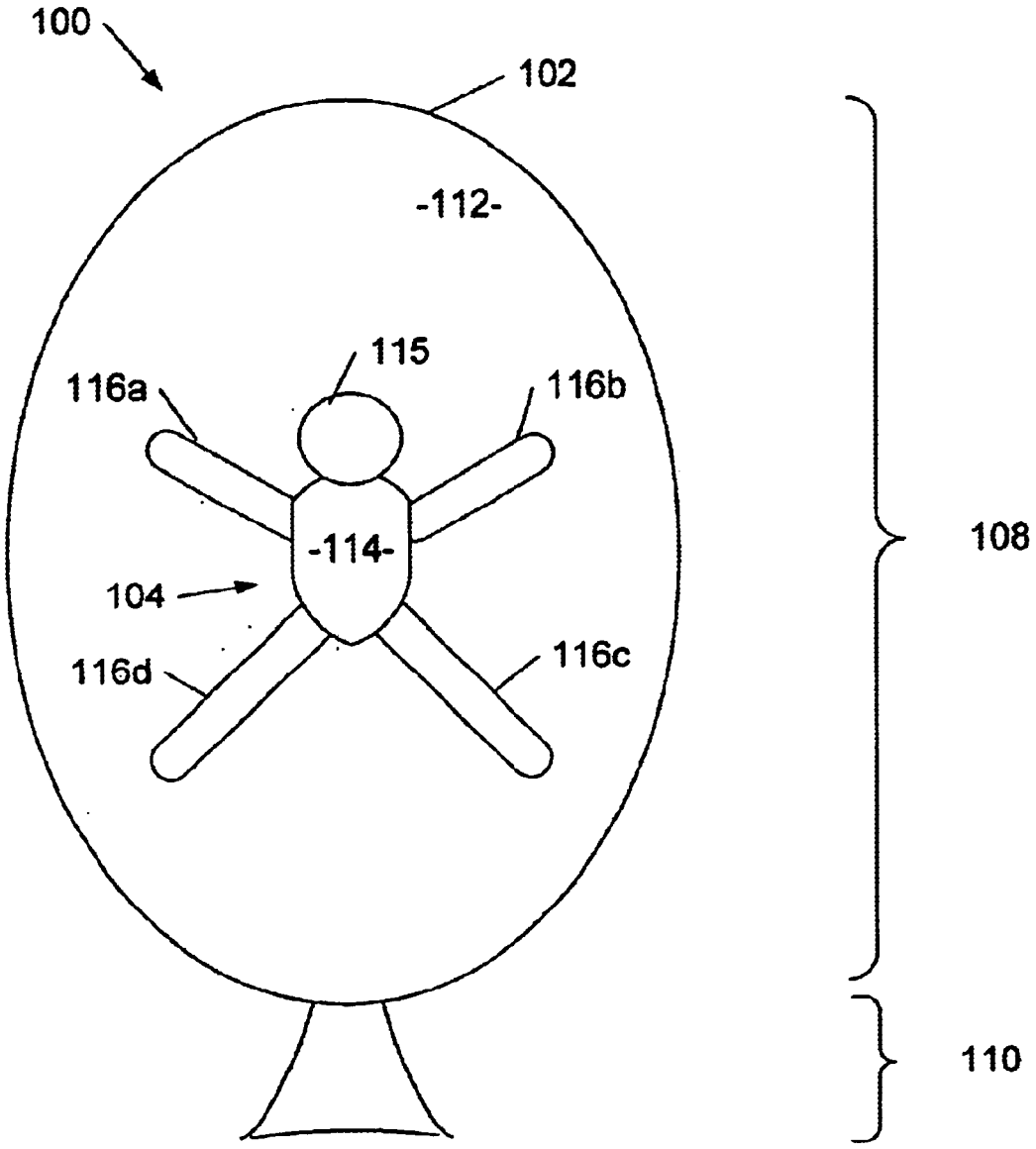
FIG. 3 is an illustration of the FIG. 1 inflatable toy with the inflatable volume substantially inflated.

FIG. 3 shows the inflatable toy 100 in an inflated condition. FIG. 1 and FIG. 3 show that the inflatable volume 102 includes a volumetric portion 108 and an inflation neck portion 110. The inflatable volume is typically grasped by the neck portion while air or gas is introduced into the interior of the volume 102 through the neck portion 110, causing the volumetric portion 108 to expand from the non-inflated condition in FIG. 1 into the inflated condition depicted in FIG. 3. If the inflatable volume 102 is a typical balloon, such as a bulbous rubber or latex balloon, then the volumetric portion 108 will typically expand in all directions upon inflation, forming a generally spherical shape. The inflatable volume can, however, be constructed so as to assume an irregular shape or other desired shape upon inflation.

Comparing FIG. 1 with FIG. 3, it can be seen that the figurine 104 is relatively stretched and expanded in FIG. 3 as compared with the figurine shape in FIG. 1, comprising a distorted shape. The figurine is attached to the outer surface 112 of the inflatable volume 102 and therefore is stretched and expanded as the inflatable volume is inflated.

FIG. 1 and FIG. 3 show that the figurine 104 includes a body portion 114 or torso, including a head 115, as well as limbs 116*a*, 116*b*, 116*c*, 116*d* extending outwardly from the body. It can be seen in FIG. 3 that the balloon has expanded in all directions as compared to its non-inflated condition in FIG. 1, and the figurine 104 has similarly been stretched in all directions. The figurine illustrated in FIG. 1 through FIG. 3 is constructed to be uniformly expandable. Thus, the size and shape of the figurine 104 as shown in FIG. 3 is larger than the size and shape of the figurine in FIG. 1 by a similar proportion as the enlargement of the balloon itself. As a result, the body portion 114 is larger in FIG. 3 as compared with FIG. 1 by a similar proportion as the balloon itself, comparing FIG. 3 with FIG. 1. Likewise, the area of the figurine limbs 116*a*, 116*b*, 116*c*, 116*d* is greater in FIG. 3 by a similar proportion as the increase in size of the, inflatable volume 102.

The change in shape can be a source of amusement, as one observes the expansion of the figurine 104 along with the expansion of the balloon 102 during inflation. As described further below, the figurine can be constructed so that it is differentially expandable, thereby providing a distortion that is not the symmetric expansion depicted in FIG. 3, but rather does not fully preserve the shape of the body and limbs upon expansion.

Figure 4:
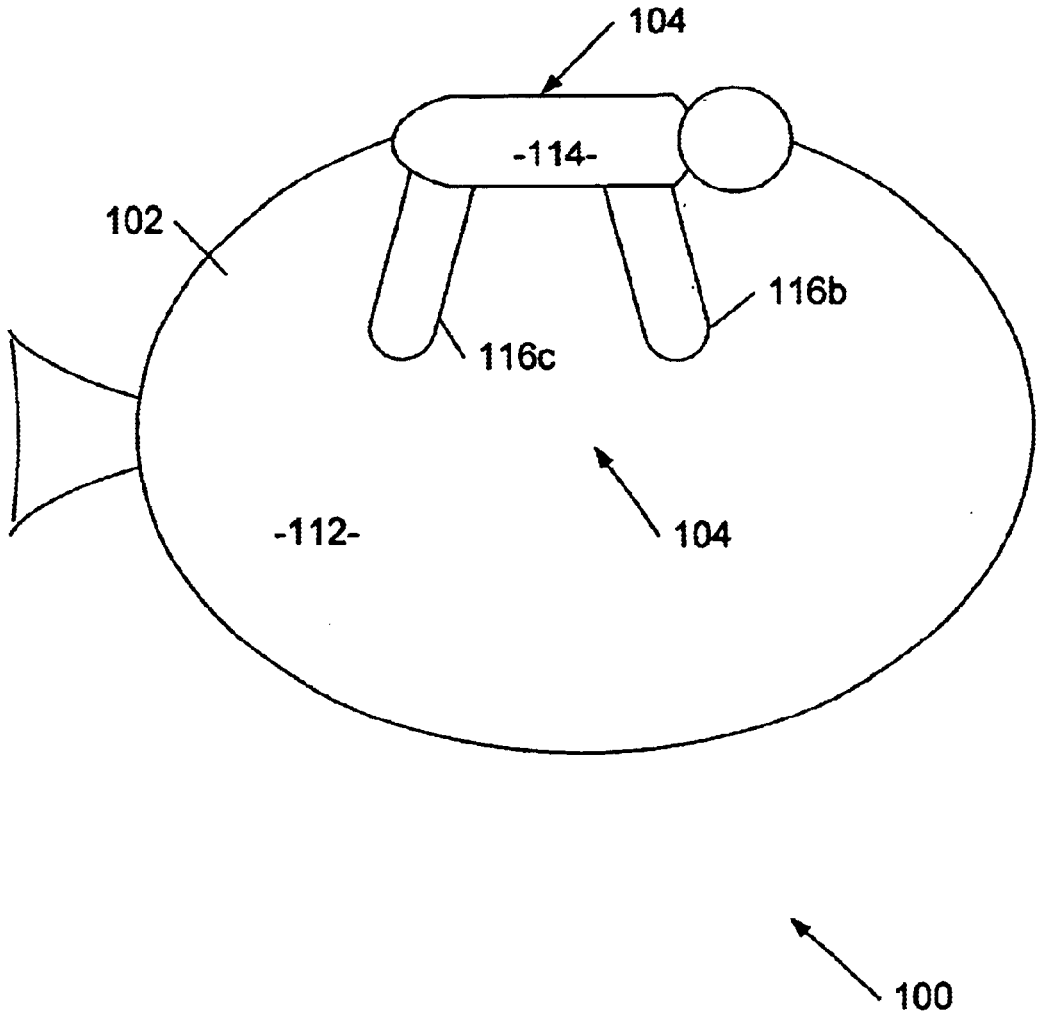
FIG. 4 is a side view of the inflatable toy from the perspective of FIG. 2 showing the toy substantially inflated as in FIG. 3.

FIG. 4 shows the toy in FIG. 3 from a side elevation view, and illustrates that the figurine 104 is attached to the balloon 102 such that the entire bottom surface of the figurine is substantially in contact with the outer surface of the balloon, even as the balloon is inflated. Thus, the bottom surface of the body portion 114 and of the limbs 116*a-d* are substantially in constant contact with the outer surface 112.

It should be noted that the increase in size and shape of the figurine 104 from the non-inflated condition of the volume 102 to the inflated condition is not exactly proportional. For example, the figurine 104 is generally flat in the non-inflated condition (see FIG. 2), whereas the balloon (and attached figurine) are shown expanded according to a spherical volume in FIG. 3 and FIG. 4.

FIG. 3 and FIG. 4 show an inflatable toy 100 constructed such that the figurine 104 is uniformly expanded as the inflatable volume 102 is inflated. The toy, however, can be constructed such that the figurine is differentially stretched as the volume is inflated.

One way to achieve differential stretching of the figurine can be to construct the figurine such that some figurine portions are stretched more readily than other portions, the different portions having different propensities to expand. For example, a molded creature figurine can be constructed with a body portion that expands or stretches more slowly than limb portions. Figurines of other shapes can likewise have portions that are differentially stretched during inflation. The relative proportion of expansion can be controlled by selection of materials of construction. Another way to achieve differential stretching is to attach selected portions of the figurine to the inflatable volume and not attach other portions of the figurine. In either of these two scenarios, the inflatable toy with differential stretching will resemble the toy 100 illustrated in FIG. 1 when it is in a non-inflated condition. An inflatable toy that provides differential stretching is illustrated in FIG. 5 through FIG. 7.

Figure 5:
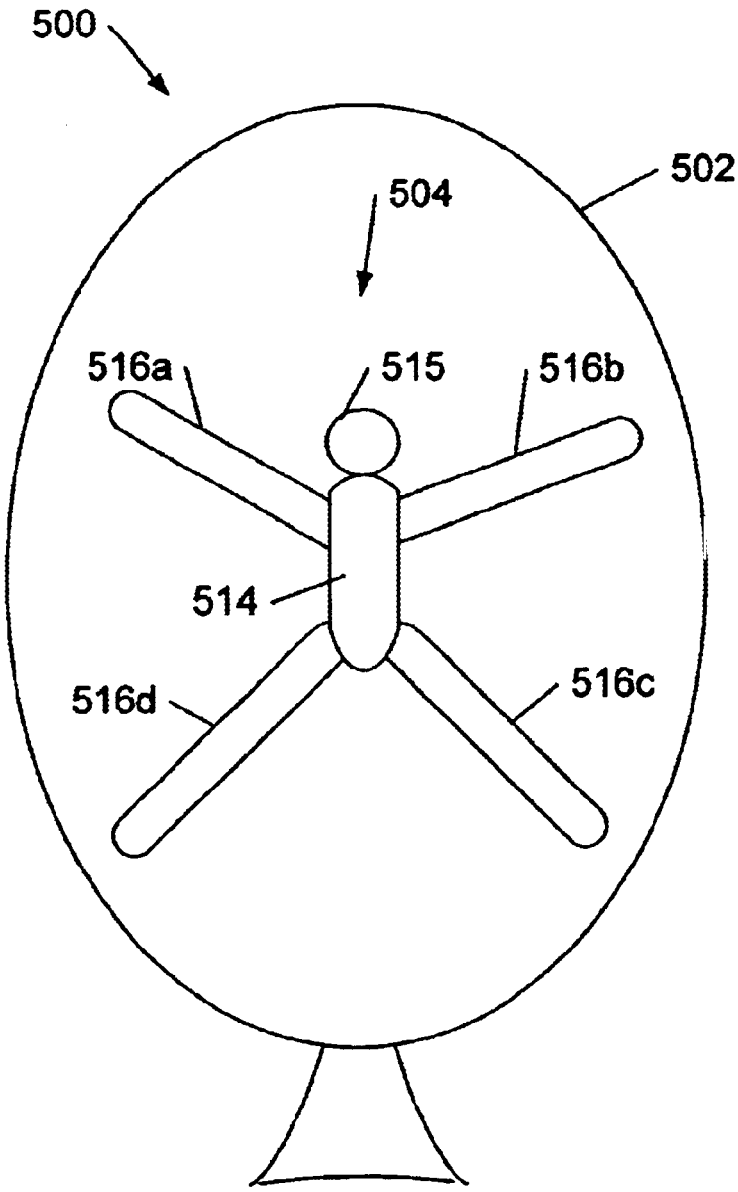
FIG. 5 is a perspective view of an alternative embodiment of an inflatable toy constructed in accordance with the invention in an inflated condition.
Figure 6:
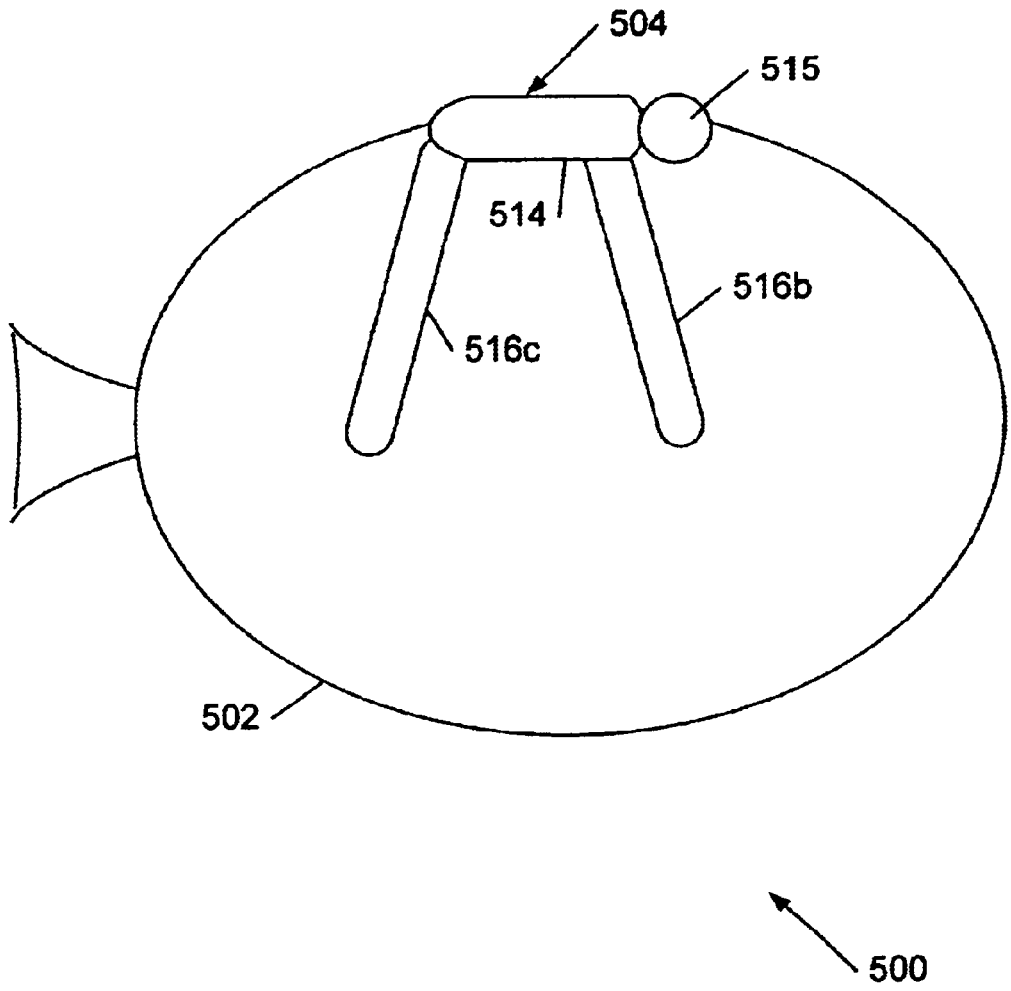
FIG. 6 is a side view of the FIG. 5 inflated toy.

FIG. 5 and FIG. 6 show a perspective view and side view, respectively, of an inflatable toy 500 with an inflatable volume 502 to which is attached a differentially stretched figurine 504. As with the previous drawings, the depicted figurine comprises a molded stretchable frog or similar creature. Comparing FIG. 5 and FIG. 6 with FIG. 3 and FIG. 4, it can be seen that the differentially stretched figurine 504 includes a figurine torso portion 514 and head 515 that are substantially unchanged in size and shape from that of the original condition (shown in FIG. 1), whereas the differentially stretched limbs 516 and have been elongated and pulled away from the torso portion and head.

As noted above, one way to achieve the differential figurine stretching is to construct the figurine so it expands in the desired manner. For example, the body portion and head portion can be constructed of a less expandable material as compared with the figurine limbs. Another way to achieve differential figurine stretching is to differentially attach the figurine to the inflatable volume. That is, the entire underside of the figurine can be attached or adhered to the surface of the inflatable volume, or only selected portions or edges of the figurine can be attached to the inflatable volume. Because of the possibilities with differential attachment and differential figurine construction, it is possible to achieve differential figurine stretching with either differential attachment or differential construction, or both. It should also be noted that figurine stretching that is uniform, or proportional, can be achieved even with differential attachment, depending on the construction of the figurine and its resulting properties.

Figure 7:
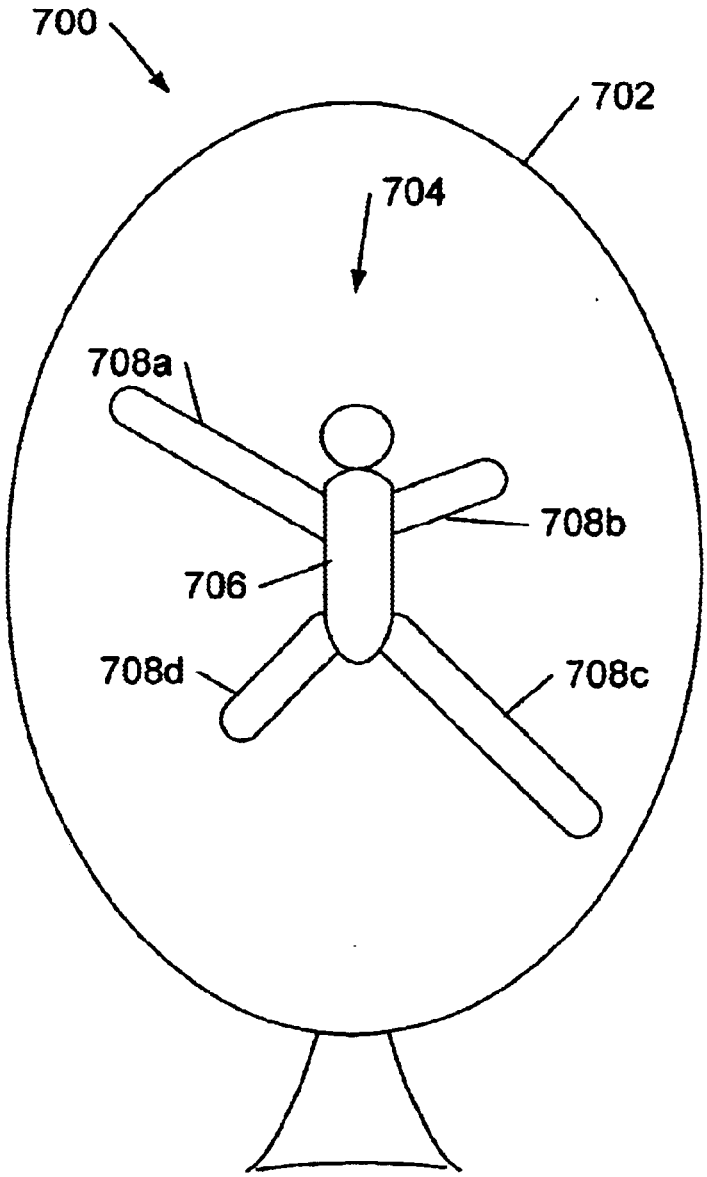
FIG. 7 is a perspective view of another alternative embodiment of an inflatable toy constructed in accordance with the invention, depicted in an inflated condition.

FIG. 7 shows an embodiment of an inflatable toy 700 constructed in accordance with the present invention in which a relatively more radical stretching has been achieved, as compared with FIGS. 5 and 6. Thus, FIG. 7 shows an inflatable volume 702 to which is attached a figurine 704 with body portion 706 and limbs 708*a*-708*d* such that different limbs are expanded and stretched to different extents as compared with the inflatable toy in a non-inflated condition (as shown in FIG. 1). Other more radical or freakish distortions of the figurine upon inflation can be provided, as desired.

Figure 8:
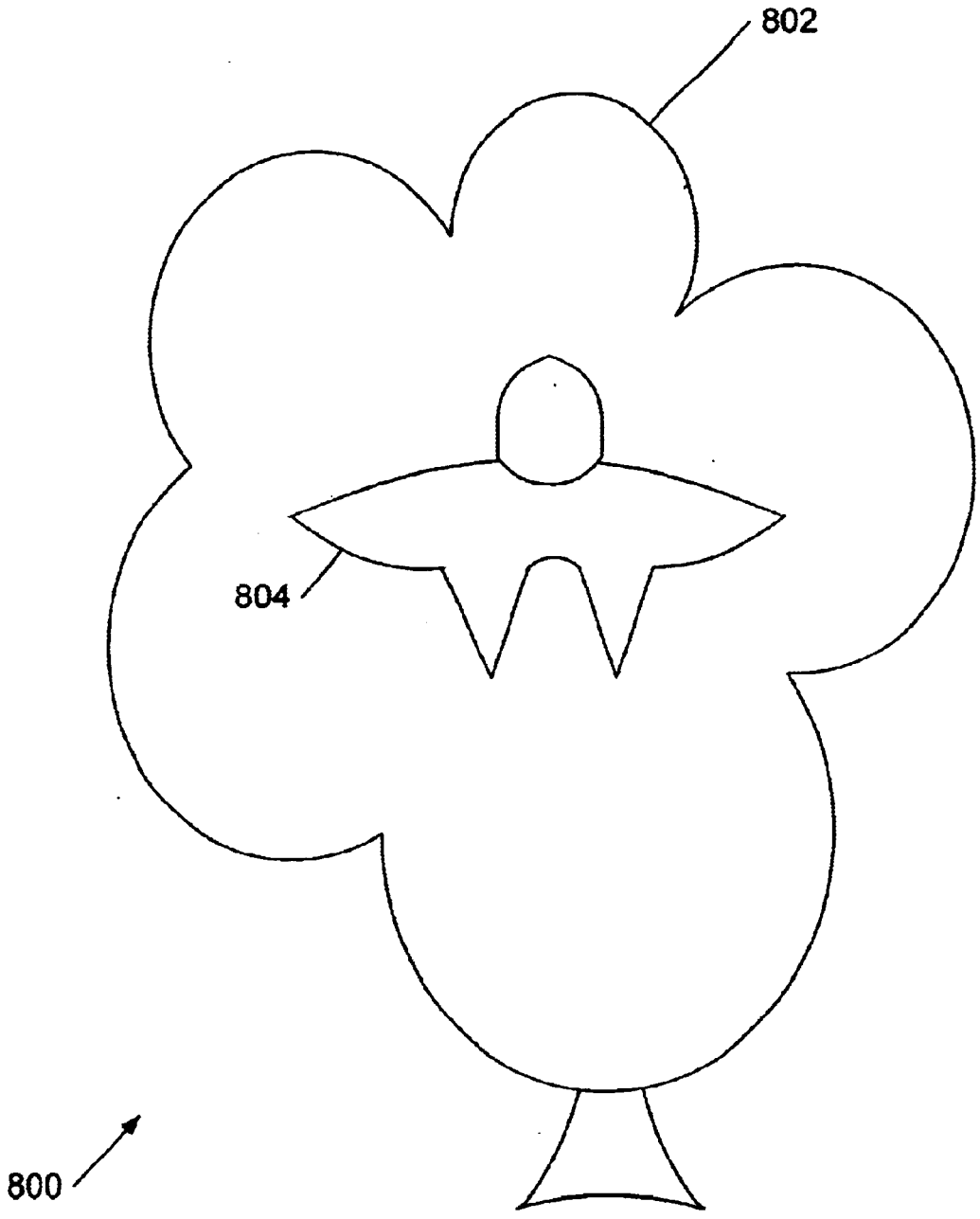
FIG. 8 is a perspective view of yet another alternative embodiment of an inflatable toy constructed in accordance with the invention, depicted in an inflated condition.

FIG. 8 shows another alternative embodiment of an inflatable toy 800 in which the inflatable volume is constructed so as to expand in an irregular manner. More particularly, FIG. 8 shows an elongated balloon 802 that expands into an inflated condition in which it adopts a caricature shape so as to resemble a desired character or creature. The expandable figurine 804 that is attached to the balloon is stretched and expanded accordingly.

Figure 9:
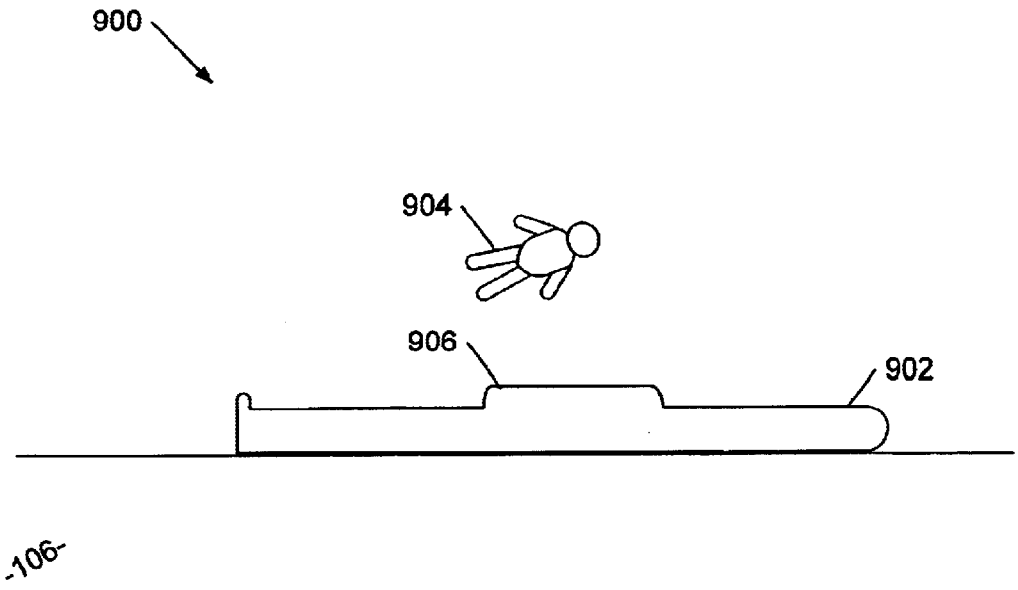
FIG. 9 is a perspective view of an inflatable toy as shown in FIG. 3 and FIG. 4 after the expandable figurine has been removed from the inflatable volume.

FIG. 9 show another embodiment of an inflatable toy 900 in which it is possible to remove the figurine 904 from the surface of the inflatable volume 902. In FIG. 9, the inflatable volume 902 is in a non-inflated condition and is lying on a surface 106, and the figurine 904 is removably attached to the surface of the inflatable volume and has been peeled away from the inflatable volume, so that the figurine has resumed the shape it had in the non-inflated condition. FIG. 9 shows that removing the figurine leaves behind a convex disfigurement 906 of the inflatable volume that is generally in the shape of the figurine. The disfigurement itself can be an additional source of amusement.

A variety of materials and constructions can be utilized for the inflatable toy described herein. For example, a suitable figurine can comprise the "Sticky Fingers" product available from Club Earth of Cumberland, R.I., USA. A suitable inflatable volume can comprise inflatable latex balloons such as widely available from numerous amusement toy companies.

The figurines described above can be attached to the inflatable volume by adhesives, deposited on desired areas of the figurine underside or lower surface. The figurines can then be pressed against the surface of the inflatable volume, thereby imparting the characteristics to the assemblage as described above. For differential stretching, then, the figurine limbs can be coated with adhesive and the figurine body can be left uncoated. The figurine itself can be provided with a sticky coating or can be provided with a tacky construction so as to adhere to the surface of the inflatable volume. Either construction is appropriate, so long as the stickiness or tackiness is sufficient to adhere the figurine to the inflatable volume as the volume is inflated. The figurines are generally removable from the inflatable volume, rather than permanently affixed. The shapes and colorings of the figurines can be varied for greater amusement, as can the shapes and forms depicted, as desired.

The present invention has been described above in terms of presently preferred embodiments so that an understanding of the present invention can be conveyed. There are, however, many configurations for inflatable toys not specifically described herein but with which the present invention is applicable. The present invention should therefore not be seen as limited to the particular embodiments described herein, but rather, it should be understood that the present invention has wide applicability with respect to inflatable toys generally. All modifications, variations, or equivalent arrangement and implementations that are within the scope of the attached claims should therefore be considered within the scope of the invention.

I claim:

1. An inflatable toy method comprising:

providing an inflatable toy comprising an expandable figurine attached to an outer surface of an inflatable volume;

inflating the inflatable volume and stretching the figurine as the inflatable volume is inflated;

wherein the expandable figurine has a bottom surface that is adhesively attached to the inflatable volume;

wherein attaching comprises removably attaching the figurine to the inflatable volume; and further comprising removing the figurine from the inflatable volume after inflation of the inflatable volume with the figurine attached, and leaving behind a convex distortion on the surface of the inflatable volume, in the shape of the figurine.

2. A method as defined in claim 1, wherein the expandable figurine assumes a predetermined shape when the inflatable volume is in a deflated state, and assumes a different shape representing a distortion of the predetermined shape after the inflatable volume is substantially inflated.

* * * * *